US006322396B1

(12) United States Patent
Kuan

(10) Patent No.: US 6,322,396 B1
(45) Date of Patent: Nov. 27, 2001

(54) MODULAR COMMUNICATION CONNECTOR

(75) Inventor: Chi-Te Kuan, Shulin (TW)

(73) Assignee: L&K Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 09/687,948

(22) Filed: Oct. 13, 2000

(51) Int. Cl.[7] ..... H01R 13/648
(52) U.S. Cl. ..... 439/607; 379/438
(58) Field of Search ..... 439/607, 95; 379/438

(56) References Cited

U.S. PATENT DOCUMENTS 5,782,646 * 7/1998 Broadfield et al. ..... 439/607
5,812,660 * 9/1998 Suzuki et al. ..... 439/607
6,093,057 * 7/2000 Lok ..... 439/607

* cited by examiner

*Primary Examiner*—Tho D. Ta
(74) *Attorney, Agent, or Firm*—Pro-Techtor International Services

(57) ABSTRACT

A modular communication connector comprises an insulating base, a shielding member, a terminal, a contact terminal, and a battery-charging terminal are accommodated in the insulating base respectively, wherein the insulating base is a flat cuboid, which have a terminal receiving slot, a contact terminal receiving slot, and a battery-charging terminal base are disposed transversally on the insulating base, the shielding member is enclosed the insulating base and defines a charging slot with the battery-charging terminal base, on which the charging slot has an position-identifying portion that is a deviated bracket forming inwardly the battery-charging slot by pressing, so as to prevent incorrect installation with a DC connector.

13 Claims, 3 Drawing Sheets

MODULAR COMMUNICATION CONNECTOR

BACKGROUND OF THE INVENTION

1. Field of the Invention

The present invention relates to a modular communication connector, more particularly to a small and compact modular communication connector being assembled to a mobile phone has both communication and battery-charging functions.

2. Description of the Prior Art

Mobile phones offer a convenient way for communications, which differs from a conventional telephone restricting our communications to specific places, and mobile phones become very popular due to its mobility. However, a blemish in the otherwise perfect thing that the insufficient power supplies of the mobile phone causes many problems to our communications. Hence, it is necessary to bundle a battery charger with a mobile phone. The conventional battery-charging equipment that comes with the mobile phone can be divided into models of battery base charger, DC charging slot, or device having both battery base charger and DC charging slot. Among them, the device having both battery base charger and DC charging slot is more powerful in functions, and gains better response from the market than other models. However, the DC charging slot come with the plastic housing of the connector as a whole piece, that has circular insert holes on the plastic housing, and charging terminals are inserted into the center of the housing. Because of the consideration for the plastics injected molding, the overall thickness of the housing needs to maintain a certain ratio, therefore it is not able to reduce its volume effectively. It is difficult to design a housing with reduced volume for the mobile phone, and the size does not comply with the current trend for compact design of the phone. Furthermore, the quality of signal transmissions is one of the key requirements of the mobile phone, and the conventional plastic structure of the battery-charging slot is unable to prevent external noise interference. If the exterior of the housing is covered by metal-shielded members, then the overall thickness will be increased, which will not comply with the compact design either.

In view of the shortcomings and inconvenience of the prior art mentioned above, which are the subjects of improvements for a long time, hence the inventor of the present invention based on years of experience accumulated from the engagement in the related industry conducted extensive research to resolve the foregoing shortcomings and invented the present invention as disclosed below.

SUMMARY OF THE INVENTION

Therefore, the primary objective of the present invention is to provide a modular communication connector, having an excellent shielding to effectively prevent noise interference. The volume of the innovative structure is smaller and lighter than the conventional prior arts, which facilitates the reduction of the overall volume of the mobile phone, and provides a compact design complying with the current trend.

According to one aspect of the present invention, a modular communication connector include an insulating base, a shielding member, a terminal, a contact terminal, and a battery-charging terminal wherein the shielding member is enclosed the insulating base and defines a charging slot with the battery-charging terminal base, on which the charging slot has an position-identifying portion that is a deviated bracket forming inwardly the battery-charging slot by pressing, so as to provide correct installation with a DC connector when the modular communication connector are in use.

BRIEF DESCRIPTION OF THE DRAWINGS

To make it easier for our examiner to understand the objective of the invention, structure, innovative features, and performance, we use a preferred embodiment together with the attached drawings for the detailed description of the invention.

Other objects, features, and advantages of the invention will become apparent from the following detailed description of the preferred but non-limiting embodiment. The description is made with reference to the accompanying drawings, in which.

DESCRIPTION OF THE PREFERRED EMBODIMENT

Figure 1:
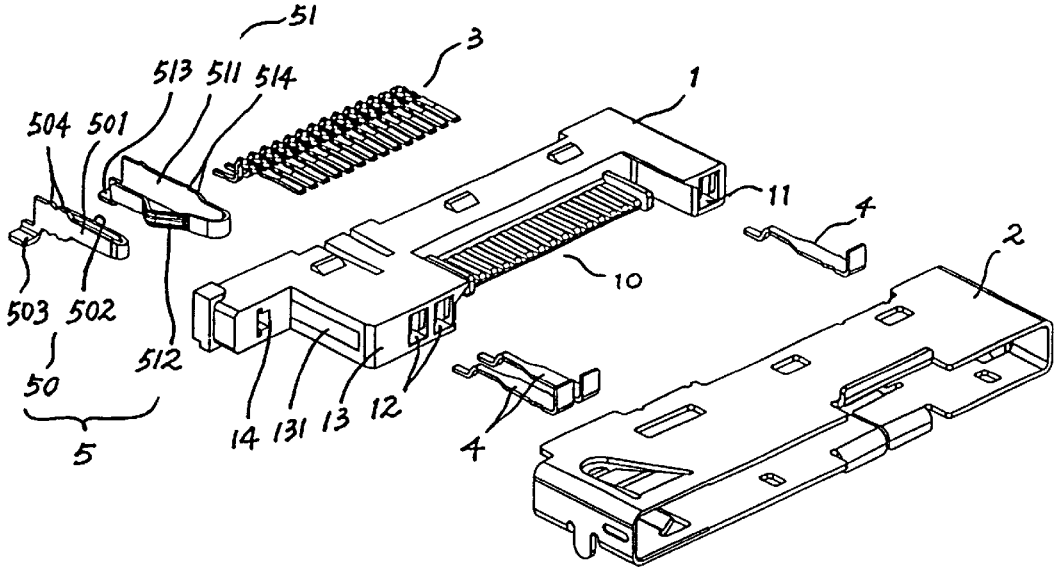
FIG. 1 shows a three-dimensional diagram of the disassembled parts of the modular communication connector of the present invention.
Figure 3:
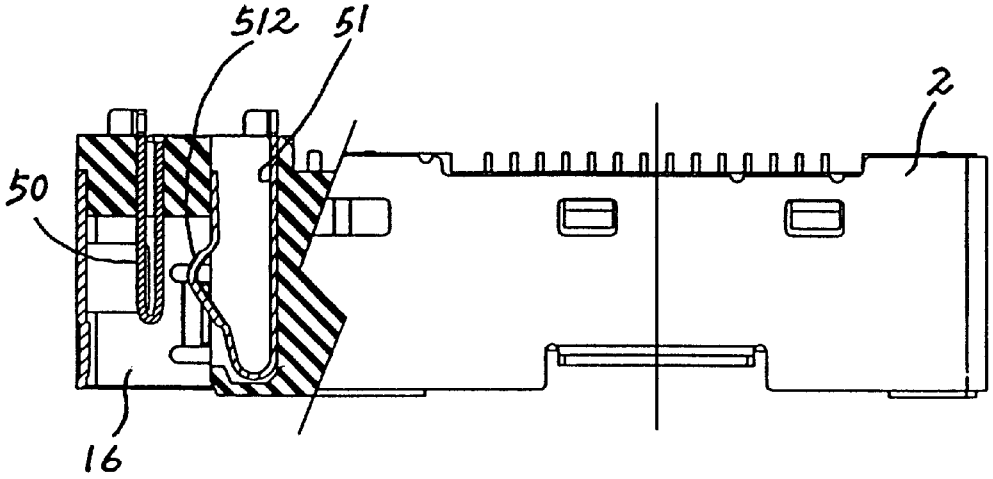
FIG. 3 shows a cross-sectional diagram of the A—A surface in FIG. 2.
Figure 4:
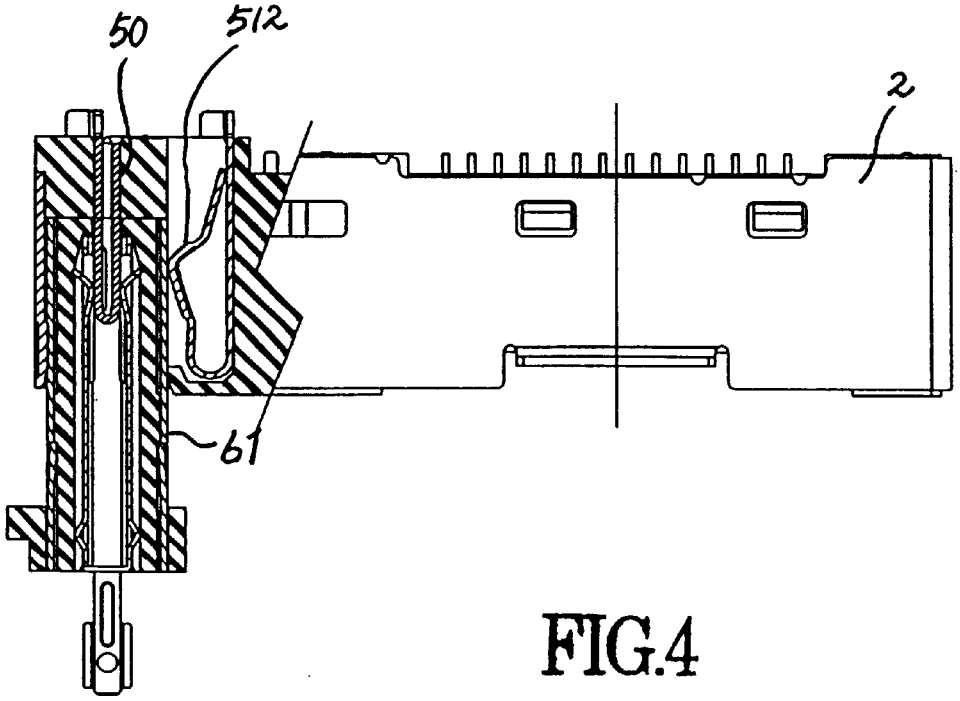
FIG. 4 shows a cross-sectional diagram of the insertion of the DC connector to the battery-charging slot of the modular communication connector according to the present invention.

Please refer to FIG. 1 for the modular communication connector, which mainly comprises an insulating base 1, a shielding member 2, a terminal 3, a contact terminal 4, and a battery-charging terminal 5, wherein he insulating base 1 is in the shape of a flat cuboid further comprising a plurality of terminal receiving slots 10 for receiving and fixing the terminal 3. A contact terminal receiving slot 11,12 are disposed on the left side and the right side of the terminal receiving slots 10 respectively for receiving contact terminal 4, the contact terminal slot 11 is one which be disposed on the right side of the terminal receiving slots 10 and the contact terminal slot 12 are two which be disposed on the left side of the terminal receiving slots 10 Referring to FIG. 3, a battery-charging terminal base 13 and an installing hole 14 are disposed on near the left side of the contact receiving slot 12 of the insulating base 1, as show in FIG. 4, the battery-charging terminal base 13 has an opening 131 on the lateral side for being accommodated the contact portion of the battery-charging terminal 5 and appropriately exposed to electrically contact with a DC connector 61 (which will be described in details later.)

Figure 2:
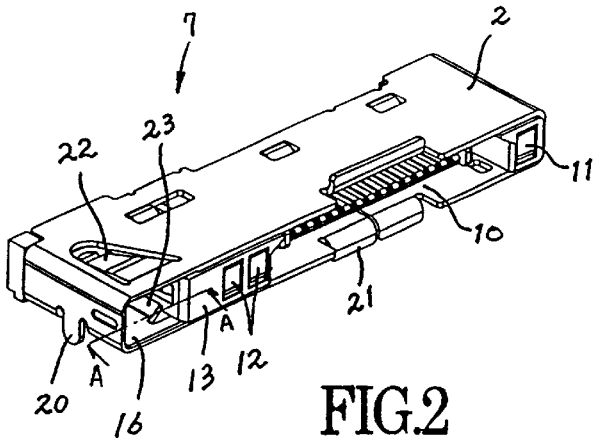
FIG. 2 shows a three-dimensional diagram of the assembled structure of the disassembled parts as shown in FIG. 1.
Figure 5:
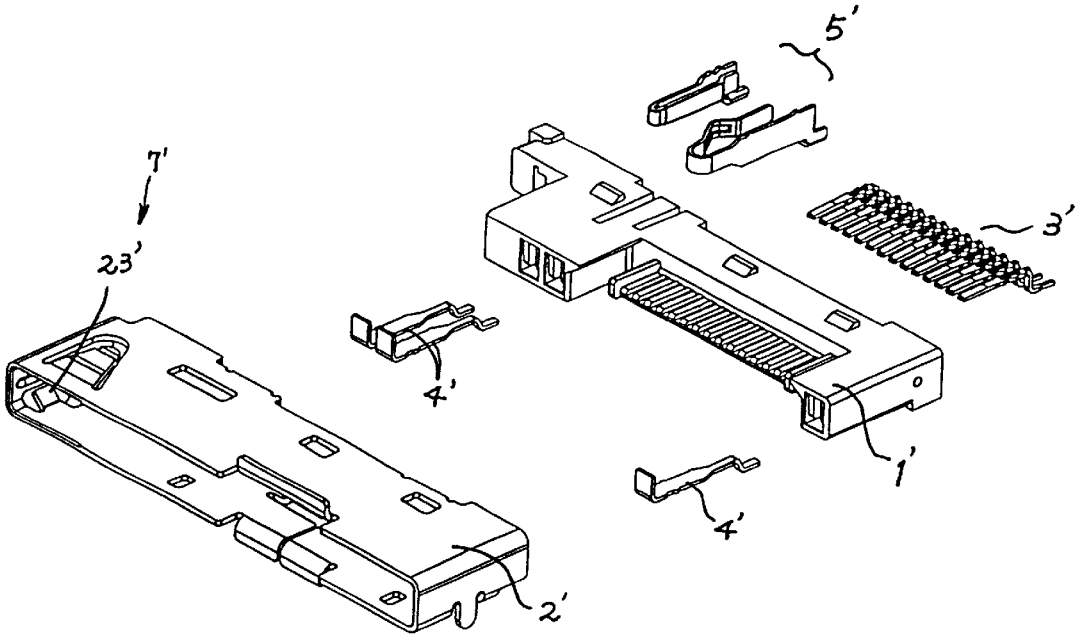
FIG. 5 and FIG. 6 are the three-dimensional diagrams of the dissembled parts and assembled parts of a second embodiment of the present invention respectively.

The shielding member 2, made of metal material, covers the external periphery of the insulating base 1 such that the terminal receiving slots 10, the contact terminal receiving slot 11, 12, and the battery-charging terminal base 13 are shielded and is enclosed forming a battery-charging slot 16 (as show in FIG. 2) with the battery-charging terminal base 13 for mating with a DC connector, and the battery-charging slot 16 is generally square in shape as shown in FIG. 5 that can be connected to a square DC connector 61. Furthermore, the bottom edge of both lateral sides of the shielding member 2 has a fixing post 20 for fixing the connector of the present invention to a printed circuit board. Furthermore, an edge on the side of the battery-charging slot 16 is opposite the shielding member 2 has a bent blocking bracket 21 in which the blocking bracket 21 is used to press against the edge of a printed circuit board to prevent any displacement when the DC connector is plugged into the connector of the present invention. In addition, an elastic stopper bracket 22 is opposite the battery-charging slot 16 which is disposed on the shielding member 2 and is formed toward the shielding member 2 inwardly by pressing to provide a clipping force on which the DC connector 61 match with the battery-charging slot 16. Furthermore, the elastic stopper bracket 22 has a thinner side that is far away from the slot of the battery-charging slot 16 for reinforcing its elastic motion. Secondarily, a position-identifying portion 7 is disposed on a lateral side of the shielding member 2 which is a deviated bracket 23 forming inwardly the battery-charging slot 16 by pressing on which the deviated bracket 23 is formed a slant at a corner on a side of the printed circuit board where adjacent to the slot of the battery-charging slot, such that it becomes an obstacle to the space of the battery-charging slot 16 and the DC connector 61 has to avoid the deviated bracket 23 before it can be smoothly inserted into the battery-charging slot 16, otherwise it will be blocked by the deviated bracket 23. Please refer back to FIG. 1, the battery-charging terminal 5 of the present invention comprises a positive electrode and a negative electrode of a first charging terminal 50 and a second charging terminal 51 which are disposed back to back, wherein the first charging terminal 50 is assembled to the battery-charging terminal base 13 which includes a base 501, a contact portion 502, a soldered portion 503 and an interfering portion 504, the contact portion 502 being extended and bent backward from the base 501, the soldered portion 503 being extended and bent from the other side of the base 501 is soldered horizontally onto a printed circuit board, and the interfering portion 504 is disposed on the edge of the base 501 on which the interfering portion 504 is located at the upper section of the soldered portion 503. The second charging terminal 51 is installed to the installing hole 14 which includes a base 511, a contact portion 512, a soldered portion 513, and a interfering portion 514, wherein the soldered portion 513 can be soldered horizontally onto the printed circuit board.

Figure 7:
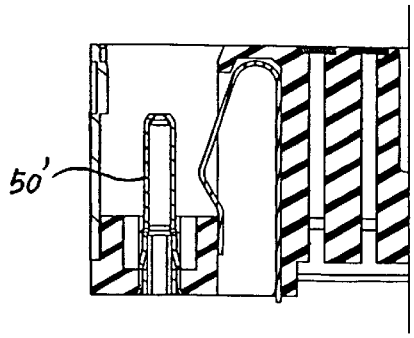
FIG. 7 is a partial cross-sectional diagram of the first charging terminal of a second embodiment being assembled to the insulating member according to the modular communication connection of the present invention.
Figure 6:
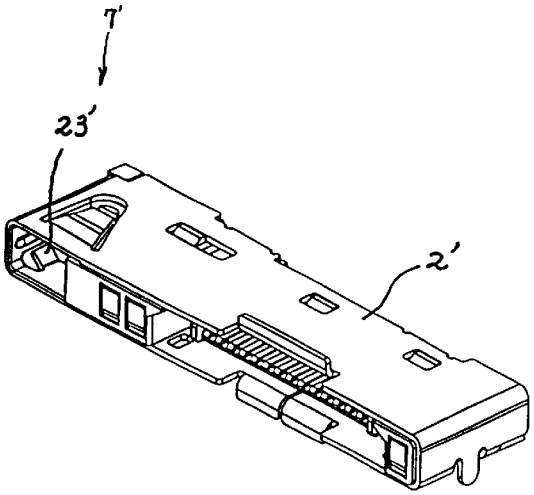

Please continue to refer to FIGS. 5 and 6, which shows another embodiment of the modular communication connector of the present invention. This embodiment differs from the preceding one in that the deviated bracket 23' of the position-identifying portion 7' is disposed on the other side of the battery-charging slot 16' and its structure such as an insulating base 1', a shielding member 2', a terminal 3', a contact terminal 4', and a battery-charging terminal 5' are the same as those disclosed in the first embodiment. Therefore, it also can provide a foolproof design to prevent any incorrect insert of the DC connector. Furthermore, the first battery-charging terminal 50' of the present invention as shown in FIG. 7 may have a cylindrical contact portion that allows the same effective electrical contact with the DC connector.

Therefore, in summation of the above description, the present invention obviously attains the objective of the present invention. The inventor of the present invention based on years of experience in the related industry conducted extensive research to enhance the structure of the present invention herein which is hereby submitted for patent application.

While the invention has been described in what is considered the most practical and preferred embodiments, it is understood that the invention is not limited to the disclosed embodiments, but is intended to cover various modifications and similar arrangements and procedures within the spirit and scope of the broadest interpretation and equivalent arrangements, modifications, and procedures.

What is claimed is:

1. A modular communication connector, mounted to a printed circuit board of a mobile phone, and used for signal transmission and battery-charging, comprising:

an insulating base, in the shape of flat cuboid, having a plurality of terminal receiving slots, a contact terminal receiving slot, and a battery-charging terminal base transversely disposed on said insulating base, wherein the plurality of terminal slots and the contact terminal receiving slot respectively receive a plurality of terminals and contact terminal which are soldered onto the printed circuit board;

a shielding member, made of metal, for covering the external periphery of the insulating base such that all the foregoing terminal slots are shielded and is enclosed forming a battery-charging slot with the battery-charging terminal base;

and a position-identifying portion is disposed on the lateral side of the shielding member which is a deviated bracket forming inwardly the battery-charging slot by pressing and a battery-charging terminal, accommodated in the battery-charging terminal base.

2. The communication connector as claimed in claim 1, wherein said deviated bracket is disposed at a corner on the side proximal to the printed circuit board, and adjacent to the slot of the battery-charging slot.

3. The communication connector as claimed in claim 2, wherein said battery-charging terminal comprising a positive electrode and negative electrode of a first charging terminal and a second charging terminal, and each of the first and second charging terminals further comprising a base, from which a contact portion being extended and bent backward, and a soldered portion being extended and bent from the other side of the base is soldered horizontally onto the printed circuit board such that the soldered portion of the first charging terminal is disposed at an end of the base, and the soldered portion of the second charging terminal is disposed at the bent backward end, and both charging terminals are disposed opposite to each other.

4. The communication connector as claimed in claim 3, wherein the side of the first charging terminal is bent forming a curved surface, and is closed to the side of the second charging terminal.

5. The communication connector as claimed in claim 4, wherein an elastic stopper bracket is disposed on the battery-charging terminal base corresponsive to the shielding member for providing the clipping force when mating with a DC connector.

6. The communication connector as claimed in claim 5, wherein said contact terminal receiving slot have three elements, each of which has the same structure that is arranged the left side and the right side of said plurality of terminal slots respectively.

7. The communication connector as claimed in claim 6, wherein the ends of said terminal and contact terminal soldered to the printed circuit board are on the same soldered side after appropriate bending, and horizontally soldered onto the printed circuit board.

8. A communication connector, being mounted onto a printed circuit board of a mobile phone, used for signal transmission and battery-charging, comprising:

an insulating base, in the shape of flat cuboid, which further having a plurality of terminal receiving slots, a contact terminal receiving slot, and a battery charging terminal base transversely disposed on said insulating base, wherein the plurality of terminal slots and the contact terminal receiving slot respectively receive a plurality of terminals and contact terminal which are soldered onto the printed circuit board;

a shielding member, made of metal, for covering the external periphery of the insulating base such that all the foregoing terminal slots are shielded and is enclosed forming a battery-charging slot with the battery-charging terminal base;

and a position-identifying portion is disposed on the lateral side of the shielding member which is a deviated bracket forming inwardly the battery-charging slot by pressing and a charging terminal, further comprising a positive electrode and negative electrode of a first charging terminal and a second charging terminal, wherein the first charging terminal comprising a cylindrical contact portion and a soldered portion being bent and horizontally soldered onto the printed circuit board, and the second charging terminal comprising a base, a base from which a contact portion being extended and bent backward, and a soldered portion being extended and bent from the other side of the base is soldered horizontally onto the printed circuit board.

9. The communication connector as claimed in claim 8, wherein said deviated bracket is disposed at a corner on the side proximal to the printed circuit board, and adjacent to the slot of the battery-charging slot.

10. The communication connector as claimed in claim 9, wherein said shielding member is formed a battery-charging slot with the battery-charging terminal base which is generally a square shape for mating with a DC connector..

11. The communication connector as claimed in claim 10, wherein an elastic stopper bracket is disposed on the battery-charging terminal base corresponsive to said shielding member for providing the clipping force when mating with a DC connector.

12. The communication connector as claimed in claim 11, wherein the lateral side of the elastic stopper bracket has a thinner side which is away from the slot of the battery-charging slot such that reinforces the elastic action of the elastic stopper bracket.

13. The communication connector as claimed in claim 12, wherein said contact terminal receiving slot have three elements, each of which has the same structure that is arranged for adjacently attaching the left side and the right side of said plurality terminal slots.

* * * * *